US006811236B1

(12) United States Patent
Spong et al.

(10) Patent No.: US 6,811,236 B1
(45) Date of Patent: Nov. 2, 2004

(54) DOOR OPENING AND CLOSING SYSTEM

(75) Inventors: Keith Brookes Spong, Auckland (NZ); Graeme Colin Fuller, Dunedin (NZ); Gerald David Duncan, Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/763,318

(22) PCT Filed: Aug. 16, 1999

(86) PCT No.: PCT/NZ99/00139

§ 371 (c)(1),
(2), (4) Date: Jul. 9, 2001

(87) PCT Pub. No.: WO00/11296

PCT Pub. Date: Mar. 2, 2000

(30) Foreign Application Priority Data

Aug. 19, 1998 (NZ) ..... 331456

(51) Int. Cl.[7] ..... A47B 96/04
(52) U.S. Cl. ..... 312/405; 312/222; 49/276
(58) Field of Search ..... 312/400, 401, 312/405, 116, 222, 326; 49/478.1, 364, 379, 276; 62/440, 441, 449

(56) References Cited

U.S. PATENT DOCUMENTS

| | | | | | |
|---|---|---|---|---|---|
| 3,635,511 | A | | 1/1972 | Waller | |
| 3,647,165 | A | | 3/1972 | Whitla | |
| 3,658,370 | A | | 4/1972 | Wang | |
| 3,764,172 | A | | 10/1973 | Standke | |
| 3,835,660 | A | * | 9/1974 | Franck | 62/277 |
| 3,860,277 | A | | 1/1975 | Wang | |
| 4,155,610 | A | * | 5/1979 | Englund | 312/222 |
| 4,428,607 | A | | 1/1984 | Levine | |
| 4,506,407 | A | | 3/1985 | Downey | |
| 4,536,043 | A | * | 8/1985 | Berglund et al. | 312/222 |
| 5,138,743 | A | | 8/1992 | Hoffman | |
| 5,293,020 | A | | 3/1994 | Han et al. | |
| 5,415,010 | A | * | 5/1995 | Woo | 312/404 |
| 6,079,216 | A | * | 6/2000 | de Marsillac Plunkett et al. | 62/440 |

FOREIGN PATENT DOCUMENTS

| | | | | |
|---|---|---|---|---|
| DE | 3837547 A | | 11/1988 | |
| JP | 401179885 | * | 7/1989 | 62/265 |
| JP | 401234784 | * | 9/1989 | 62/265 |
| JP | 63040 | | 1/1994 | |
| JP | 406082147 | * | 3/1994 | 62/155 |
| JP | 07018943 A | | 1/1995 | |
| JP | 11218379 | | 8/1999 | |
| SE | 9200194 A | | 1/1992 | |

* cited by examiner

*Primary Examiner*—Lanna Mai
*Assistant Examiner*—Hanh V. Tran
(74) *Attorney, Agent, or Firm*—Trexler, Bushnell, Giangiorgi, Blackstone & Marr, LTD

(57) ABSTRACT

An apparatus assists a user to move a door between closed and open states. The apparatus includes a permanent magnet provided on the door. An electromagnet is located on the door frame adjacent thereto when the door is closed and is energizable to provide a magnetic field which reinforces the permanent magnetic field or to provide a magnetic field in opposition to the permanent magnetic field. A detector detects the state of the door and an interface detects the presence of a user. A controller receives input from the detector and the interface and energizes the electromagnet to provide a reinforcing magnetic field if a user is attempting to open the door and provides an opposing magnetic field to the permanent magnetic field if the door is closed and the user is attempting to open the door.

20 Claims, 2 Drawing Sheets

DOOR OPENING AND CLOSING SYSTEM

FIELD OF THE INVENTION

This invention relates to door opening and/or closing and/or latching devices and especially though not solely to devices which may be used in conjunction with home appliance doors, such as refrigerator doors to assist in opening and closing these doors.

BACKGROUND TO THE INVENTION

A conventional door must be opened by physically pulling on the door and closed by physically pushing on the door. In order to maintain the door in a closed position a latch is often incorporated so that opening and closing then also involves physically connecting and disconnecting the latch mechanism.

In refrigerator cabinets, the doors there has long been a problem of holding the door closed in order that cooled air does not escape thereby warming and spoiling the contents. Refrigerator doors have been fitted with a gasket which is often formed from a plastic material which seals between the door and the door frame. The gasket often has a permanent magnetic strip incorporated therein which assists in holding and sealing the door to the door frame. The gasket has been designed to incorporate the aforementioned magnetic strip and has not, therefore, been designed with optimal thermal sealing properties in mind and this aspect of its design could be improved. Also, the fact that the magnet is positioned in the gap between the door and frame means that it provides a path for heat conduction into the refrigerator cabinet through this gap. In addition, the magnet necessitates the use of metal door frame surrounds in order that the magnet may be attracted to the door frame thus providing a further path for heat conduction from the interior of the refrigerator cabinet. Furthermore, the assembly of the magnetic strip in the door gasket is a source of assembly cost due to the time and labour required which could be eliminated. However, even when this magnetic gasket is used it is often still necessary to arrange the refrigerator cabinet so that the front is raised slightly above the level of the back ensuring that the door is always biassed towards a closed position. However, it is still possible for a user to have seemingly closed the door when in reality there is still a gap between the door and frame which the existing permanent magnet can not possibly close.

In an effort to overcome this problem some refrigerator manufacturers have developed devices which prevent refrigerator doors from resting in an almost closed position. An example of such a device is disclosed in U.S. Pat. No. 5,138,743 (assigned to White Consolidated Industries Inc. ) wherein the hinge pin is attached to the cabinet through a bracket and is provided with lobe shaped camming surfaces around the pin and complementary lobe shaped camming surfaces are also provided around an aperture in the door. The two camming surfaces arranged so that the door will tend to rotate to a position where the lobes fit together which is arranged to be where the door would ordinarily close or even beyond the normal closing position so that a closing force is always applied to the door when it meets the door frame.

Another problem in present refrigerator cabinet door designs (especially large doors) is that when the door has been closed and a good seal is established between the door and frame, it is necessary to supply a relatively large force to the door in order to open it. This is disadvantageous in modem home appliances which are expected to be easy to operate and, in the case of refrigerator doors, repeatedly and easily opened with a consistent force. A door which could be reliably closed without the need for the user to occasionally manually check that this is the case would also be an improvement.

Examples of improved door latching systems and door opening/closing systems which utilise a combination of permanent and electromagnets are disclosed in U.S. Pat. Nos. 3,635,511 (Waller), 3,647,165 (Whitla), 3,658,370 (Wang), 3,764,172 (Standke), 3,860,277 (Wang), 4,428,607 (Levine), 4,506,407 (Downey) and 5,293,020 (Han et al). However, none of the aforementioned systems are intended for use in refrigerator cabinets and do not incorporate the necessary user sensing hardware and associated logic. Furthermore, many of the systems disclosed require a mechanical latching mechanism in association with the magnetic components.

It is, therefore, an object of the present invention to provide a door opening, closing and/or holding system which will at least go someway towards overcoming the above disadvantages or which will at least provide the public with a useful choice.

SUMMARY OF THE INVENTION

In one aspect the invention consists in a door state changing apparatus for assisting a user to move a door between a closed state where the door is positioned adjacent a door frame and an open state comprising:

- permanent magnet means on or attached to said door to provide a permanent magnetic field,
- electromagnet means on or attached to said door frame adjacent said permanent magnet means when said door is in said closed state, which electromagnet means is energisable to provide a magnetic field in a first direction to reinforce said permanent magnetic field and energisable to provide a magnetic field in a second direction to oppose said permanent magnetic field,
- door position detection means to detect the state of said door,
- user interface means to detect the presence of a user attempting to alter the state of said door, and
- control means which receives input from said door position detection means and said user interface means and provides a control signal to energise said electromagnet means to provide a magnetic field in said first direction if said user interface means indicates a user is attempting to alter the state of said door and said door position detection means indicates that said door is in said open state and provides a control signal to energise said electromagnet means to provide a magnetic field in said second direction if said user interface means indicates a user is attempting to alter the state of said and said door position detection means indicates that said door is in said closed state.

In a further aspect the invention consists in a home appliance including a cabinet and a door hingeably connected to said cabinet and closeable against a door frame said appliance including door state changing apparatus for assisting a user to move said door between a closed state and an open state where said door is positioned adjacent said door frame and an open state, said door state changing apparatus comprising:

- permanent magnet means on or attached to said door to provide a permanent magnetic field, electromagnet means on or attached to said door frame adjacent said permanent magnet means when said door is in said closed state, which electromagnet means is energisable to provide a magnetic field in a first direction to reinforce said permanent magnetic field and energisable to provide a magnetic field in a second direction to oppose said permanent magnetic field, door position detection means are also provided to detect the state of said door, user interface means to detect the presence of a user attempting to alter the state of said door, and control means which receives input from said door position detection means and said user interface means and provides a control signal to energise said electromagnet means to provide a magnetic field in said first direction if said user interface means indicates a user is attempting to alter the state of said door and said door position detection means indicates that said door is in said open state and provides a control signal to energise said electromagnet means to provide a magnetic field in said second direction if said user interface means indicates a user is attempting to alter the state of said and said door position detection means indicates that said door is in said closed state.

In a still further aspect the invention consists in a refrigerator including door state changing apparatus as set forth above.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

Figure 1:
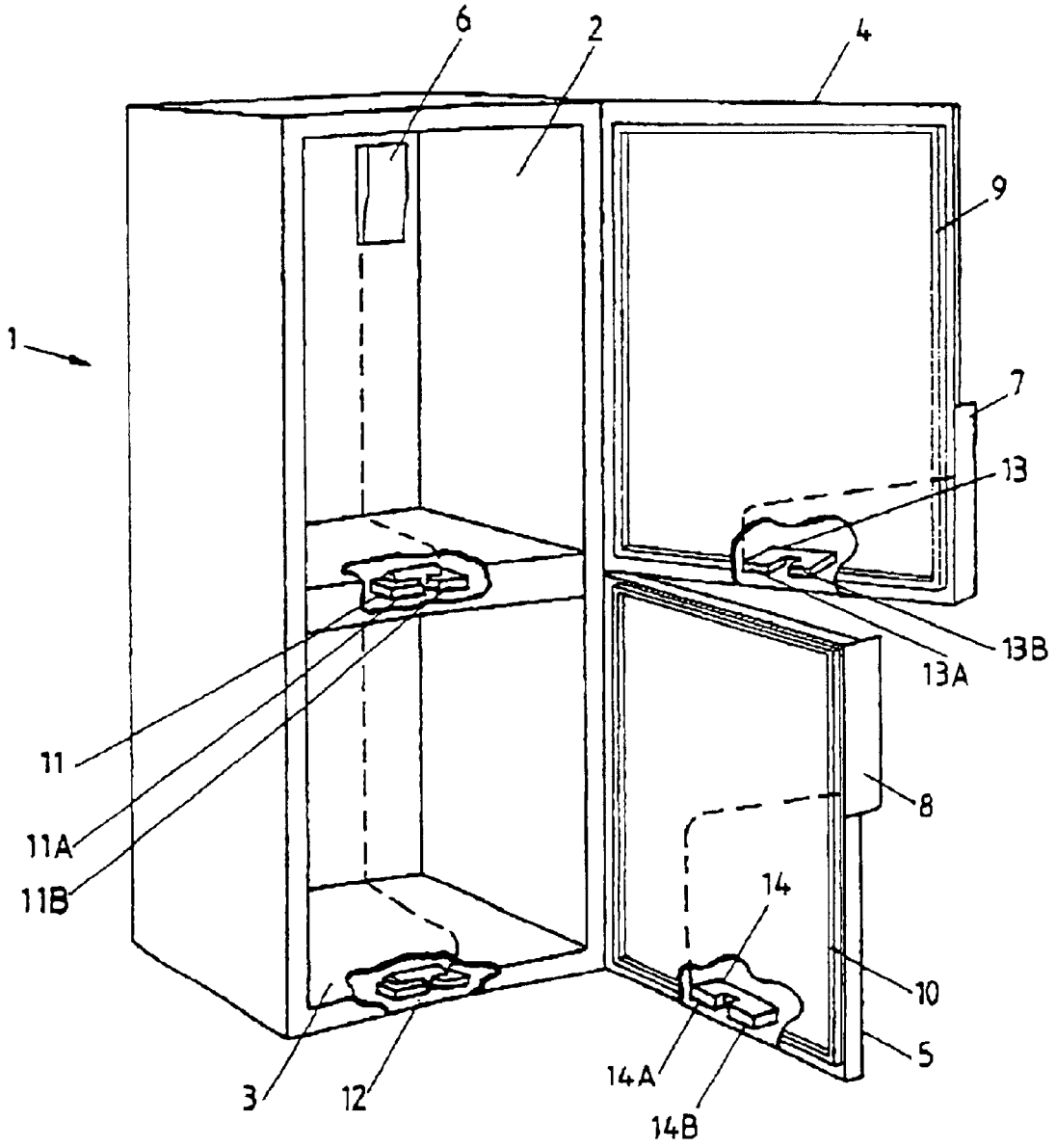
FIG. 1 is a partially cut away perspective view of a refrigerator incorporating the preferred form of the present invention cabinet with both compartment doors open.
Figure 2:
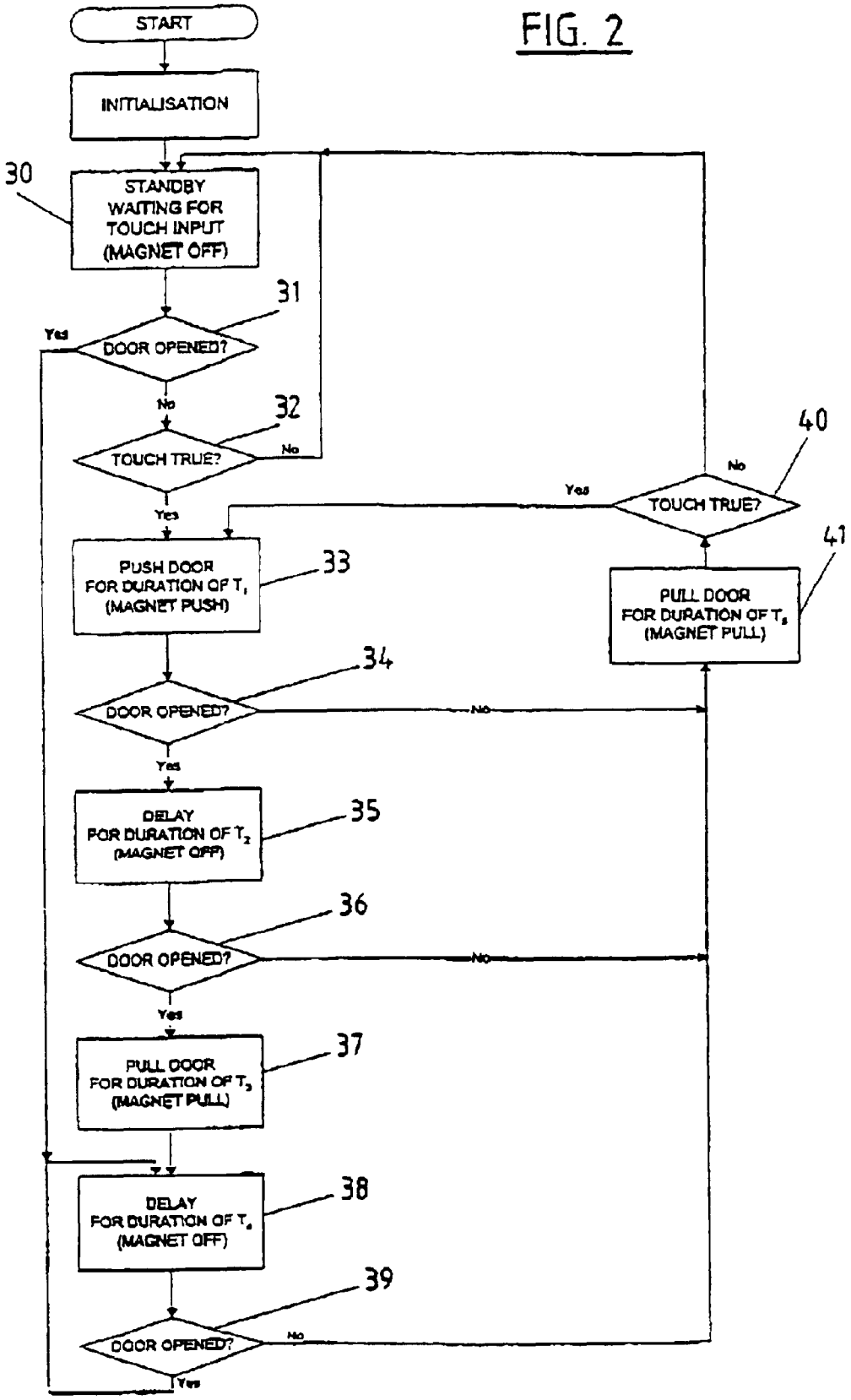
FIG. 2 is a flow diagram showing the operation of the preferred form of the present invention on either one of the refrigerator or the freezer compartments of the refrigerator shown in FIG. 1.

With reference to the drawings and in particular FIG. 1, a refrigerator cabinet 1 incorporating the door opening and/or closing system according to one preferred embodiment of the present invention is shown. Although the preferred embodiment of the invention will be described with reference to a refrigerator cabinet, however, it should be apparent to those of ordinary skill in the art that the invention is equally applicable to most if not all doors which require some form of seal such as chest freezers, microwave ovens, and could even be used in doors which do not require a seal such as household doors.

The refrigerator cabinet 1 shown in FIG. 1 is provided with a refrigeration compartment 2 (sometimes referred to as the "product compartment") and a freezer compartment 3, adapted to be cooled by a refrigeration system (not shown) to respective temperatures. The refrigeration compartment 2 and the freezer compartment 3 each comprise side walls, top wall, bottom wall and rear wall with a front opening provided to allow items of food to be placed within the compartments. Normally the refrigerator cabinet would be formed from sheet steel, however it should be appreciated that the present invention will allow the cabinet to be formed from a plastics material. A refrigeration compartment door 4 is attached, for example by hinges (not shown) to one edge of the cabinet 1 in order to close the front opening of the refrigeration compartment. Similarly, a freezer door 5 is attached to an edge of the cabinet 1 to close the front opening in the freezer compartment. Gaskets 9 and 10 are provided around the periphery of the internal surface of the refrigerator and freezer compartment doors 4 and 5 respectively. Gaskets 9 and 10 are preferably formed from a flexible and compliant yet heat insulating material such as a standard plastics refrigerator door seal (although a "standard" refrigerator door sealing gasket is fitted with a magnetic strip to bias the door closed against the normally metallic compartment, the magnetic strip is not required in the gasket according to the preferred form of the present invention and thus, as previously mentioned, the cabinet could be formed from a plastics material).

A control means or electronic controller 6 (which may comprise a microprocessor with associated circuitry and memory storage devices) is positioned within cabinet 1. Controller 6 preferably stores and executes a software program which controls the operation of the refrigerator. In addition to controlling the temperature of the refrigeration and freezer compartments of the refrigerator (by controlling the refrigeration system and the states of any valves or fans in the path of cooled air from the refrigeration system to the compartments 2 and 3) controller 6 also receives input from door sensors, for example touch sensitive pads 7 and 8 positioned on the refrigeration and freezer compartment doors respectively.

Means for locking and unlocking compartment doors 4 and 5 are provided in each compartment. Preferably the means for locking and unlocking comprise electromagnets 11 and 12 provided in one of the walls of refrigerator compartment 2 and freezer compartment 3 respectively. Electromagnet 11 is connected for energisation to controller 6 and is preferably positioned in such a way as to produce separated poles (11A, 11B) in a plane parallel with a front facing wall of the compartment. The electromagnet is preferably able to be energised in either direction so that pole 11A could be a North or a South pole on demand. Electromagnet 11 is preferably positioned within one of the compartment walls but adjacent a surface which is in contact with or nearly contacts a part of the refrigerator compartment door when closed. The construction and arrangement of electromagnet 12 is preferably the same as that described above with reference to electromagnet 11. It should be noted that the positioning of the electromagnets 11 and 12 is not crucial and could be altered. For example, the electromagnets could be positioned in the front facing vertical wall of the cabinet furthest from the hinges.

Complimentary to each of electromagnets 11 and 12 are door mounted keeper means 13 and 14 positioned respectively in parts of the refrigerator and freezer doors which are adjacent the compartment electromagnets when the doors are shut or nearly shut. It can be seen in the example shown in FIG. 1 that the keeper means are provided in the lower edge of each door. Preferably the keeper means are formed from a ferromagnetic substance so that they are attracted towards their respective electromagnets when energised. More preferably, the keeper means are actually permanent magnets with their own North (13A, 14A) and South (13B, 14B) poles.

Door sensors 7 and 8 provide controller 6 with a "touch" signal which may be used to determine the presence of a user's hand in contact with the pads indicating that a user is about to open or close one of the doors (or has just opened or closed a door and is still in contact with it). As the touch sensitive pads 7 and 8 are provided on the compartment doors, the touch signals must somehow be transmitted to controller 6 through the gap between door and cabinet. One way of achieving this is by providing wires through the hinge pins in the doors or by using the hinge pin as a conductor. This would ensure that the touch signal could be provided to controller 6 independent of whether the door is open or closed.

Alternatively, and more preferably, the touch signals are transmitted from the door to the controller 6 without wires. This may be accomplished by providing an electrically conductive but non-magnetic cover over the permanent magnets in the compartment doors and wiring these to their respective touch sensitive pads. Further electrically conductive yet non-magnetic covers are also provided over the electromagnets in the refrigerator cabinet which are wired to the controller 6. In this way, an electrical coupling is provided between the permanent magnet cover and the electromagnet cover such that an electrical touch signal may be passed through the air gap between the door and the cabinet 1. It will be appreciated that this signal transmission method will only work when the door is closed or nearly closed.

The following is an example of the preferred use of the present invention with the refrigerator compartment. It will be appreciated that preferred operation of the invention in association with the freezer compartment or any other compartment is the same.

In use and with reference to FIG. 3, controller 6 first initialises then enters a standby mode at block 30 in which it checks whether the compartment door is open in decision block 31. This could be accomplished for example by providing a mechanical sensor or switch would senses the position of door 4 and transmits an appropriate signal to controller 6. Alternatively a Hall Effect sensor could be provided to detect the presence of the door mounted permanent magnet 13 and transmit an appropriate signal to controller 6. In the preferred form of the present invention however, the door position is detected by sensing the inductive property of electromagnet 11. It will be appreciated that reluctance to the flux produced by the electromagnet will be greater when the door is opened (a large air gap between the North and South poles) than when the door is closed and the flux is able to flow through the permanent magnet (with two very small air gaps). By sensing the reluctance of the magnetic circuit it is therefore possible to detect the open or closed state of the door without the necessity of additional sensors.

If door 4 is found to already be open then a timer is started and a period $T_4$ is waited in block 38 before the door position is again detected in block 39. If the door is found to now still be open then a further delay of period $T_4$ is waited in block 38 before the door position is again detected. If it is found that the door has not been closed for some length of time (for example 5 minutes) then it may be necessary to alert a user by, for example, energising a buzzer to produce an audible alarm.

If in block 39 the door is found to now be closed then at block 41 controller 6 energises electromagnet 11 to pull the door closed. This is accomplished by energising the electromagnet in a direction which will cause pole 11A to be a North pole and pole 11B to be a South pole. Accordingly, the magnetic fields of the permanent magnet and the electromagnet will reinforce each other and the a closing force will be provided to door 4. The electromagnet is energised for a duration of $T_5$ seconds which has been calculated as sufficient to close the door. The electromagnet is then de-energised and the door will remain closed due to the attraction between the permanent magnet in door 4 and the ferromagnetic core of electromagnet 11.

In block 40 controller 6 senses whether touch sensitive pad 7 has detected the presence of a user's hand. In the preferred form of the present invention, a high frequency (for example a 150 kHz "saw tooth" wave form) signal is provided to the touch sensitive pad 7 by an oscillator through a current limiting protection circuit and a capacitive filter (to block mains "hum" of 50 or 60 Hz). It is known that the human body appears as a capacitive load to ground of approximately 100 pF. Accordingly, at 150 kHz the human body has an impedance of approximately 11 kΩ. The touch switch 7 is provided with the high frequency wave form from a source impedance of, for example, 47 kΩ so that human contact with the touch sensitive pad significantly attenuates the oscillator output. The oscillator output/touch switch voltage may then be filtered to remove the AC component of the touch signal which may then be provided to controller 6 as an average DC level. The average DC level could then be converted to a digital value by an Analogue to Digital Converter to simplify processing by a microprocessor.

If in block 40 it is decided that a user has not contacted the touch sensitive pad 7 then the standby mode is again entered at block 30 where controller 6 waits for touch pad 7 to be reactivated with all compartment doors closed.

If in block 40 it is found that a user has contacted the touch pad 7 then a user must be about to open door 4 and therefore control passes to block 33 where electromagnet 11 is energised in a direction such that pole 11A becomes a South pole and pole 11B becomes a North pole so that the magnetic fields of the permanent and electromagnets repel one another and the door is provided with an opening force for a duration of $T_1$ seconds. Duration $T_1$ is a sufficient time to allow door 6 to open a distance which will allow a user to easily be able to then pull the door fully open without having to pull against the attractive force between permanent magnet 13 and the core of electromagnet 11. If the door is found to then still be closed in block 34 then control returns to block 41 where the door is pulled closed again.

If the door is however open at decision block 34 then controller 6 initiates a timer for a duration of $T_2$ seconds at block 35 which is preferably a period of time sufficient to allow the average person to browse the contents of the refrigerator and withdraw or deposit items of food (for example, $T_2$ could range between 5 seconds and 30 seconds).

Once the timer has reached the predetermined duration $T_2$ a check is made as to whether the door is still open at block 36. If the door is found to be closed (or nearly closed) then control passes to block 41 where the door is pulled closed and subsequent steps are carried out as has already been described. However, if the door is found to still be open then control passes to block 38 wherein a loop is entered at block 38 in which the state of the door is regularly (after a duration of every $T_4$ seconds). As mentioned above, if this loop is followed a predetermined number of times or if the door is found to be open for a predetermined duration of time then it may be necessary to raise an alarm to alert a user that the door requires closing. Once the door is found to be nearly closed then control passes to block 41 where the door is pulled shut and subsequent steps carried out as already described.

It should be noted that the refrigerator door should, in use, ordinarily be biased in such a way to ensure that the door will tend to move is a direction which close the door. This biasing could, for example, be achieved by ensuring that the front feet of the refrigerator are raised higher than the rear feet so that the front of the refrigerator cabinet is higher than the back. Alternatively, the hinge mechanism could be designed to provide a closing force to the door, for example by the use of springs or camming surfaces (causing the opening door to also be lifted against gravity) both of which require the user to add energy to the mechanism to open the door and which use this added energy to close the door once the user has released it.

If at block 31 the door is found to be closed prior to controller 6 sensing the users touch at block 32 then the electromagnet 11 will be energised with current flowing in a direction which will produce a South pole at pole 11A and a North pole at pole 11B for a duration of $T_1$ seconds (for example a duration of between 0.5 and 2 seconds). As a result, the two South poles 11A and 13B and the two North poles 11B and 13A will each repel each other thereby allowing the user to easily open the door. If the repelling magnetic forces are large enough (and depending on the weight of the door and any items of food in the door) the door could be pushed open a slight amount by this repulsion.

Accordingly, it can be seen that at least in the preferred form of the present invention, a refrigerator door opening and closing system is provided which allows the traditional door gasket to be redesigned to increase its insulating properties while also reducing the occurrence of compartment doors accidentally remaining slightly ajar after use. Accordingly, an increase in overall efficiency of a refrigerator incorporating the present invention is expected.

What is claimed is:

1. A door state changing apparatus for assisting a user to move a door between a closed state where the door is positioned adjacent a door frame and a open state comprising:

permanent magnet means on or attached to said door to provide a permanent magnetic field, electromagnet means on or attached to said door frame adjacent said permanent magnet means when said door is in said closed state, which electromagnet means is energisable to provide a magnetic field in a first direction to reinforce said permanent magnetic field and energisable to provide a magnetic field in a second direction to oppose said permanent magnetic field door position detection means to detect the state of said door, user interface means to detect the presence of a user attempting to alter the state of said door, and control means which receives input from said door position detection means and said user interface means and provides a control signal to energise said electromagnet means to provide a magnetic field in said first detection if said user interface means indicates a user is attempting to alter the state of said door and said door position detection means indicates that said door is in said open state and provides a control signal to energise said electromagnet means to provide a magnetic field in said second direction if said user interface means indicates a user is attempting to alter the state of said and said door position detection means indicates that said door is in said closed state.

2. A door state changing apparatus as claimed in claim 1 wherein said electromagnet means is de-energised when said door position detection means indicates that said door is in said closed position.

3. A door state changing apparatus as claimed in claim 2 wherein said control means includes delay means which provide a time delay between said door position detection means detecting said closed state and de-energising said electromagnet means.

4. A door state changing apparatus as claimed in claim 3 wherein said user interface means include sensing means which cover a region of the surface of said door.

5. A door state changing apparatus as claimed in claim 3 wherein said door position detection means comprise proximity detection means provided on or attached to said door frame which detects the proximity of said permanent magnet means.

6. A door state changing apparatus as claimed in claim 5 wherein said proximity detection means comprise means to sense the inductance of said electromagnet means.

7. A door state changing apparatus as claimed in claim 1 wherein said user interface means include sensing means which cover a region of the surface of said door.

8. A door state changing apparatus as claimed in claim 7 wherein said door position detection means comprise proximity detection means provided on or attached to said door frame which detects the proximity of said permanent magnet means.

9. A door state changing apparatus as claimed in claim 8 wherein said proximity detection means comprise means to sense the inductance of said electromagnet means.

10. A door state changing apparatus as claimed in claim 1 wherein said door position detection means comprise proximity detection means provided on or attached to said door frame which detects the proximity of said permanent magnet means.

11. A door state changing apparatus as claimed in claim 10 wherein said proximity detection means comprise means to sense the inductance of said electromagnet means.

12. A door state changing apparatus as claimed in claim 1 wherein said permanent magnet means is formed in a substantially "U" shape with the ends of the legs of said "U" directed towards said electromagnet means and with opposing magnetic poles at the end of each leg.

13. A door state changing apparatus as claimed in claim 12 wherein said door position detection means comprise proximity detection means provided on or attached to said door frame which detects the proximity of said permanent magnet means.

14. A door state changing apparatus as claimed in claim 13 wherein said proximity detection means comprise means to sense the inductance of said electromagnet means.

15. A door state changing apparatus as claimed in claim 1 wherein said electromagnet means comprises a substantially "U" shaped core of magnetically permeable material and an energisable winding around said core, the ends of the legs of said "U" shape being directed towards the legs of said permanent magnet means.

16. A door state changing apparatus as claimed in claim 1 wherein said permanent magnet means is positioned on or near the centre line of said door.

17. A door state changing apparatus as claimed in claim 16 wherein said door position detection means comprise proximity detection means provided on or attached to said door frame which detects the proximity of said permanent magnet means.

18. A door state changing apparatus as claimed in claim 17 wherein said proximity detection means comprise means to sense the inductance of said electromagnet means.

19. A home appliance including a cabinet and a door hingeably connected to said cabinet and closeable against a door frame said appliance including a door state changing apparatus for assisting a user to move said door between a closed state and an open state where said door is positioned adjacent said door frame and an open state, said door state changing apparatus comprising:

permanent magnet means on or attached to said door to provide a permanent magnetic field, electromagnet means on or attached to said door frame adjacent said permanent magnet means when said door is in said closed state, which electromagnet means is energisable to provide a magnetic field in a first direction to reinforce said permanent magnetic field and energisable to provide a magnetic field in a second direction to oppose said permanent magnetic field, door position detection means are also provided to detect the state of said door, user interface means to detect the presence of a user attempting to alter the state of said door, and control means which receives input from said door position detection means and said user interface means and provides a control signal to energise said electromagnet means to provide a magnetic field in said first detection if said user interface means indicates a user is attempting to alter the state of said door and said door position detection means indicates that said door is in said state and provides a control signal to energise said electromagnet means to provide a magnetic field in said second direction if said user interface means indicates a user is attempting to alter the state of said door position detection means indicates that said door is in said closed state.

20. A refrigerator including a door state changing apparatus as claimed in any one of claims 1 to 12.

* * * * *

UNITED STATES PATENT AND TRADEMARK OFFICE

CERTIFICATE OF CORRECTION

PATENT NO. : 6,811,236 B1 
DATED : November 2, 2004
INVENTOR(S) : Keith Brookes Spong, Graeme Colin Fuller and Gerald David Duncan It is certified that error appears in the above-identified patent and that said Letters Patent is hereby corrected as shown below:

Column 7,
Line 56, "detection" should be -- direction --

Column 10,
Line 6, "detection" should be -- direction --
Line 10, "said state" should be -- said open state --
Line 13, "alter the state of said door" should be -- alter the state of said and said door --

Signed and Sealed this

First Day of February, 2005

JON W. DUDAS
*Director of the United States Patent and Trademark Office*